US005915930A

United States Patent [19]

McNaull

[11] Patent Number: 5,915,930

[45] Date of Patent: Jun. 29, 1999

[54] BELLOWS OPERATED OSCILLATING PUMP

[75] Inventor: Michael H. McNaull, Ashland, Ohio

[73] Assignee: The Gorman-Rupp Company, Mansfield, Ohio

[21] Appl. No.: 08/885,554

[22] Filed: Jun. 30, 1997

[51] Int. Cl.[6] ..... F04B 35/00

[52] U.S. Cl. ..... 417/417; 417/550; 92/130 B

[58] Field of Search ..... 417/412, 417, 417/550; 92/130 B

[56] References Cited

U.S. PATENT DOCUMENTS

| | | | |
|---|---|---|---|
| 3,136,257 | 6/1964 | Smith et al. | 417/241 |
| 4,824,337 | 4/1989 | Lindner et al. | 417/417 |
| 5,567,131 | 10/1996 | McNaull | 417/417 |

OTHER PUBLICATIONS

The Gorman–Rupp Company advertisement "Oscillating Pumps", 1 page (undated).

Pump Technologies Inc. (PTI) advertisement, 2 pages (undated).

*Primary Examiner*—Charles G. Freay

*Assistant Examiner*—Paul L. Ratcliffe

*Attorney, Agent, or Firm*—Renner, Kenner, Greive, Bobak, Taylor & Weber

[57] ABSTRACT

An oscillating pump (10) includes a housing (11) which carries the components thereof. These components include an electromagnetic coil (24) surrounding an armature (23) carried by an impeller (12) which is positioned longitudinally between an inlet area (16) and an outlet area (17) of the pump (10). The armature (23) moves longitudinally upon activation of the coil (24) to the point of the greatest magnetic force generated by the coil (24). The impeller (12) includes a pair of bellows (19, 20) and carries a valve (13). The bellows (19, 20) define an inlet chamber (21) and a discharge chamber (22). Another valve (15) is carried by the housing adjacent to the discharge chamber (16). Upon activation of the coil (24) the valve (13) forces fluid in the discharge chamber (22) through the valve (15) and allows fluid to pass from the inlet chamber (21) to the discharge chamber (22) upon deactivation of the coil (24). The return force to move armature (23) in the opposite longitudinal direction is solely provided by the bellows (19, 20).

13 Claims, 3 Drawing Sheets

BELLOWS OPERATED OSCILLATING PUMP

TECHNICAL FIELD

The present invention generally relates to electromagnetically driven oscillating pumps. More particularly, this invention relates to a an oscillating pump with an elastomeric impeller which operates without the need for springs or other mechanical devices.

BACKGROUND ART

Electromagnetic oscillating pumps are well known in the art. Typically, an electromagnetic coil is utilized to move an armature carried by an impeller relative to the frame assembly of the pump. Upon energization, a bellows-shaped discharge end of the impeller, defining a discharge chamber, is compressed, thereby decreasing the volume of the discharge chamber. This decrease in volume forces the liquid inside the chamber out of the pump through a one-way discharge valve.

Upon de-energization, a spring or permanent magnet returns the impeller to its original position or beyond, thereby increasing the volume of the discharge chamber. As a result, a partial vacuum is created inside the discharge chamber, and liquid is drawn from an inlet end of the impeller, past a center valve, and into the discharge chamber. The electromagnetic coil is then re-energized and the cycle is repeated, thereby producing a stop-and-go flow in one direction. Oscillations on the order of 60 times per second, however, create a flow that is substantially continuous.

Currently, the oscillating pumps known in the art use springs or a permanent magnet as the opposing force to the electromagnetic forces. McNaull U.S. Pat. No. 5,567,131, for example, discloses an electromagnetic oscillating pump using a spring biased valve and a return spring to retract the armature. At least one disadvantage to using springs, however, is that they add unnecessary complexity to the pump, thereby increasing the costs and the possibility of a mechanical failure. In addition, springs and permanent magnets often provide an excessive return force which diminishes the efficiency or performance of the electromagnetic coil.

The present invention is advantageous in that it is simpler to use, manufacture, and maintain, and is less expensive and more reliable than those devices known in the art. Therefore, the need exists for an electromagnetic oscillating pump that does not require springs, a permanent magnet, or other mechanical devices to provide the return force for the armature.

DISCLOSURE OF THE INVENTION

It is therefore an object of the present invention to provide an electromagnetically driven oscillating pump that will transfer a fluid in an essentially continuous manner.

It is another object of the present invention to provide a pump, as above, that does not contain springs or a permanent magnet.

It is yet another object of the present invention to provide a pump, as above, that has an elastomeric impeller providing the sole motive force opposing the electromagnetic force.

It is a further object of the present invention to provide a pump, as above, that is simple and inexpensive to manufacture and maintain.

These and other objects of the present invention, which will become apparent from the description to follow, are accomplished by the improvements hereinafter described and claimed.

In general, an oscillating pump for moving a fluid longitudinally from an inlet area to a discharge area includes a housing having an electromagnetic coil therein. An impeller through which the fluid may pass from the inlet area to the discharge area includes a first bellows adjacent to the inlet area and a second bellows adjacent to the discharge area. An armature is positioned adjacent to the coil and is carried by the impeller such that upon activation of the coil, the armature moves in the longitudinal direction and the first bellows is expanded while the second bellows is compressed and the fluid is transferred through the discharge area. Upon deactivation of the coil, the first and second bellows provide the sole force to move the armature in the opposite longitudinal direction.

A preferred exemplary oscillating pump incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
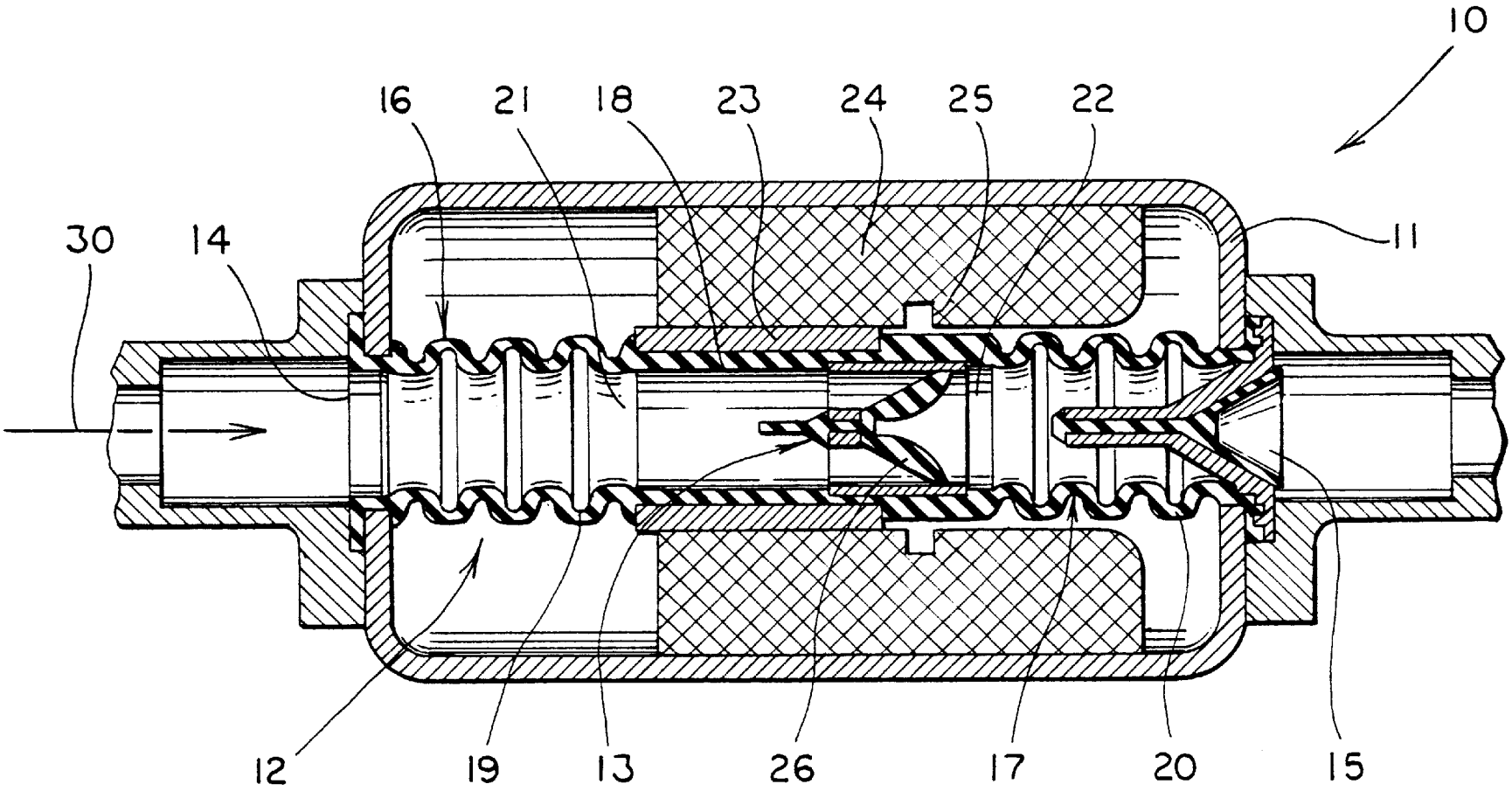
FIG. 1 is a somewhat schematic longitudinal cross section of an oscillating pump according to the present invention showing the pump in the static position.

An oscillating pump according to the present invention is indicated generally in the accompanying drawings by the numeral 10. Pump 10 is designed and works best when positioned directly on a substantially planar surface. Pump 10 includes a housing 11 which may be fabricated from any of a variety of materials, but it has been found that fabricating housing 11 from a hard plastic results in a sturdy device that is relatively easy and inexpensive to manufacture.

An impeller, generally indicated by the numeral 12, is positioned within housing 11 and is a substantially hollow, cylindrical member preferably made from a single elastomeric material. Impeller 12 carries a center valve 13 which is preferably of the type shown in U.S. Pat. No. 4,824,337, to which reference is made for a complete understanding of this invention. Fluid is permitted to enter impeller 12 longitudinally through inlet 14 and exits through a discharge area which includes a discharge valve 15 carried by housing 11. Discharge valve 15 is preferably a conventional poppet valve. However, a leaf valve such as the preferred type of center valve 13, could also be employed for valve 15 as well.

Impeller 12 includes an inlet area, indicated generally by the numeral 16, and a discharge area, indicated generally by the numeral 17, interconnected by a central portion 18. Inlet area 16 includes a bellows 19, and discharge area 17 includes a similar bellows 20. Bellows 19 is thus adjacent to inlet 14 and bellows 20 is thus adjacent to discharge valve 15, with central portion 18 carrying center valve 13. An inlet chamber 21 is formed within impeller 12 on the inlet side of center valve 13 and a discharge chamber 22 is formed on the discharge side of center valve 13.

Both bellows 19 and bellows 20 are preferably constructed of an elastomeric material such as Burton Rubber Processing product #35550-M6, which can be obtained from Lexington Components, Inc., of Vienna, Ohio. The configuration of both bellows 19 and 20 is standard and the number of convolutions is not critical. Nevertheless, it is preferred that bellows 19 and bellows 20 each have the same number of convolutions, preferably three. In the resting or static position, shown in FIG. 1, to decrease stress on impeller 12 when pump 10 is not in use, the load on impeller 12 is preferably small or zero. A slight preload or stretching of impeller 12, on the order of approximately four percent of its static length, results in a more uniform flow rate or performance.

Central portion 18 carries a cylindrical armature 23. Armature 23 is circumferentially surrounded by an electromagnetic coil 24. As used herein, "electromagnetic coil 24" is intended to describe a conventional coil and frame assembly available, for example, from Dormeyer Industries, of Chicago, Ill.

Figure 2:
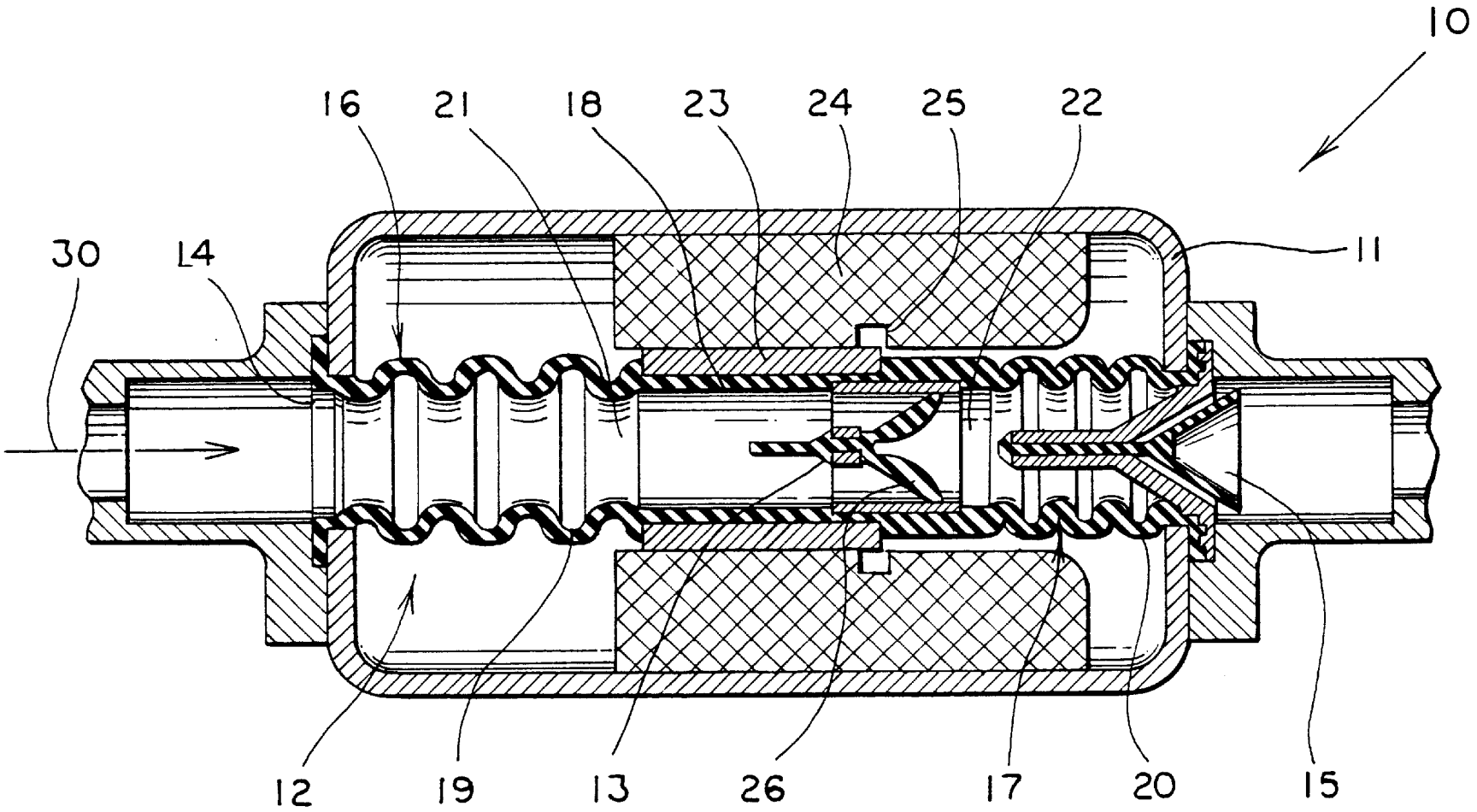
FIG. 2 is a longitudinal cross section similar to FIG. 1 showing the pump near the end of its forward, energized position.

With a conduit attached to each end of pump 10, pump 10 is in condition to pump a fluid in the direction of arrow 30. Upon the energization or activation of coil 24, armature 23 moves in the forward longitudinal direction until the forward-most end of armature 23 becomes approximately aligned, as shown in FIG. 2, with an edge 25 of electromagnetic coil 24, which is the area of greatest magnetic force. One of ordinary skill in the art, however, would realize that the range of travel by the armature is a function of the configuration of the coil. As a result of the change of the position of armature 23, discharge bellows 20 is compressed and inlet bellows 19 is expanded. As discharge bellows 20 is compressed, the volume of discharge chamber 22 is decreased, and leaves 26 of center valve 13 force fluid in discharge chamber 22 through discharge valve 15 and into a conduit. Simultaneously, inlet bellows 19 expands, thereby increasing the volume of inlet chamber 21 with an attendant decrease in pressure. This decrease in pressure induces additional fluid to enter into inlet chamber 21 through inlet 14.

Figure 3:
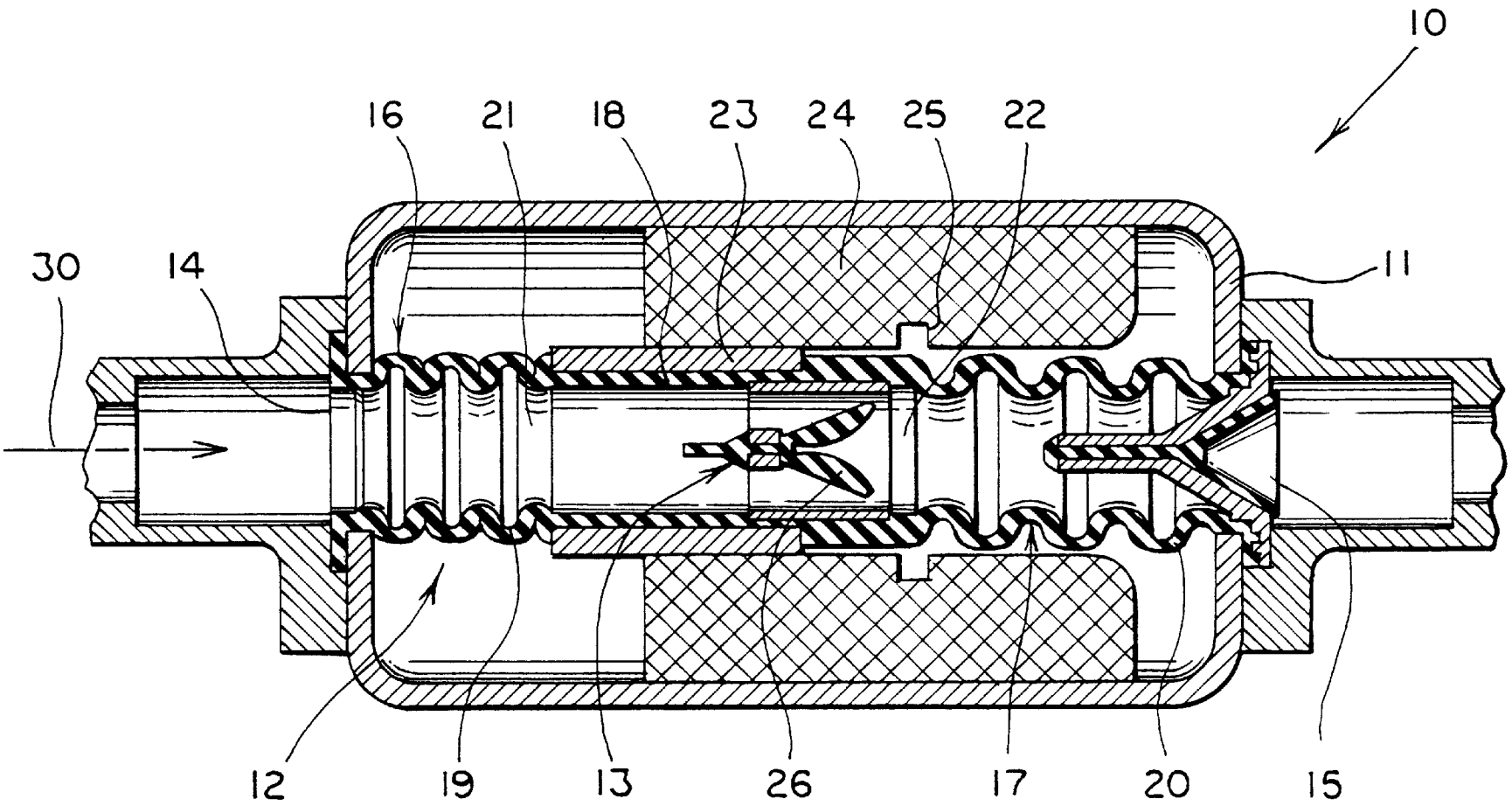
FIG. 3 is a longitudinal cross section similar to FIG. 1 showing the pump near the end of its reverse, de-energized position.

Electromagnetic coil 24 is then de-energized and the elastic forces of compressed discharge bellows 20 and expanded inlet bellows 19 provide a return force such that armature 23 moves past the static position of FIG. 1 to the position shown in FIG. 3. As inlet bellows 19 compresses and discharge bellows 20 expands, the pressure in inlet chamber 21 increases and the pressure in discharge chamber 22 decreases, thereby closing discharge valve 15 and forcing fluid from inlet chamber 21, past leaves 26 of center valve 13, and into discharge chamber 22, which fluid is thus available for discharge upon the next energization of coil 24.

In order to induce optimal return forces, the total travel of armature 23—from its least forward position in the de-energized state to its most forward position in the energized state—is preferably from about 5 to about 20 percent of the length of impeller 12. Nevertheless, one of ordinary skill in the art could determine without undue experimentation the optional total travel of armature 23 relative to the length of impeller 12 upon changing the elastomeric material of the bellows, the wall thickness of the bellows, the power of the electromagnetic coil, the size of the armature, or the like.

It should thus be evident that an electro-magnetically driven oscillating pump made in accordance with the concepts of the present invention can be used to pump a fluid utilizing the elastomeric bellows as the sole force opposing the electromagnetic source. As such, the pump accomplishes the objects of the present invention and otherwise substantially improves the art.

I claim:

1. An oscillating pump for moving fluid longitudinally from an inlet area to a discharge area comprising a housing; an electromagnetic coil in said housing; an impeller through which the fluid may pass from the inlet area to the discharge area; said impeller having a first bellows adjacent to the inlet area and a second bellows adjacent to the the discharge area; an armature positioned adjacent to said coil and carried by said impeller such that upon activation of said coil said armature moves in the longitudinal direction and said first bellows expands and said second bellows compresses and fluid is transferred through the discharge area; and upon deactivation of said coil, said first and second bellows provide the sole force to move said armature in a direction opposite to the longitudinal direction.

2. A pump according to claim 1 further comprising a first valve carried by said impeller and a second valve carried by said housing, said first valve forcing fluid through the discharge area and through said second valve upon activation of said coil.

3. A pump according to claim 2 wherein said second valve is a poppet valve.

4. A pump according to claim 1 wherein said armature moves to the point of greatest force of said coil upon activation of said coil.

5. A pump according to claim 1 wherein said first and second bellows are approximately equal in length.

6. A pump according to claim 1 wherein the inlet area and discharge area are approximately equal in volume.

7. A pump according claim 1 wherein the total travel of said armature is from about 5 to about 20 percent of the length of said impeller.

8. An oscillating pump for moving fluid longitudinally from an inlet area to a discharge area comprising a housing; an electromagnetic coil within the housing; an impeller; an armature carried by said impeller and movable in a longitudinal direction upon activation of said coil; a first valve carried by said impeller; a second valve carried by said housing; said impeller including a first elastomeric bellows adjacent to the inlet area and defining an inlet chamber, and a second elastomeric bellows adjacent to said discharge area and defining a discharge chamber; said first valve forcing fluid in said discharge chamber through said second valve upon activation of said coil and allowing fluid to pass from said inlet chamber to said discharge chamber upon deactivation of said coil; said first and second bellows providing the sole force upon deactivation of said coil to move said armature in a longitudinal direction opposite to the direction said armature moves upon activation of said electromagnetic coil.

9. A pump according to claim 8 wherein said armature moves to the point of greatest force of said coil upon activation of said coil.

10. A pump according to claim 8 wherein said second valve is a poppet valve.

11. A pump according to claim 8 wherein said first and second bellows are approximately equal in length.

12. A pump according to claim 8 wherein the inlet area and discharge area are approximately equal in volume.

13. A pump according to claim 8 wherein the total travel of said armature is from about 5 to about 20 percent of the length of said impeller.

* * * * *